US006471752B1

(12) United States Patent
Lewis

(10) Patent No.: US 6,471,752 B1
(45) Date of Patent: Oct. 29, 2002

(54) IONIZING STRUCTURE FOR AMBIENT AIR TREATMENT

(75) Inventor: Keith B. Lewis, Salt Lake City, UT (US)

(73) Assignee: Lewis Lint Trap, Inc., Salt Lake City, UT (US)

( * ) Notice: Subject to any disclaimer, the term of this patent is extended or adjusted under 35 U.S.C. 154(b) by 0 days.

(21) Appl. No.: 09/688,338

(22) Filed: Oct. 16, 2000

(51) Int. Cl.[7] ..... B03C 3/68

(52) U.S. Cl. ..... 96/20; 96/63; 96/82; 96/97; 361/233; 361/235

(58) Field of Search ..... 96/20, 26, 63, 96/97, 96, 80–82; 361/226, 233, 235, 231; 323/903

(56) References Cited

U.S. PATENT DOCUMENTS

| | | | | | |
|---|---|---|---|---|---|
| 2,279,586 | A | | 4/1942 | Bennett | 96/97 X |
| 2,979,158 | A | * | 4/1961 | Vlier, Jr. | 96/82 |
| 3,046,716 | A | | 7/1962 | Rodger | 96/97 |
| 3,624,448 | A | | 11/1971 | Saurenman et al. | 96/82 X |
| 3,768,258 | A | | 10/1973 | Smith et al. | 55/DIG. 30 |
| 3,873,282 | A | * | 3/1975 | Finch | 96/82 X |
| 3,900,766 | A | | 8/1975 | Kawada | 96/82 X |
| 3,915,672 | A | | 10/1975 | Penney | 95/81 |
| 4,061,961 | A | * | 12/1977 | Baker | 96/82 X |
| 4,339,782 | A | | 7/1982 | Yu et al. | 361/229 |
| 4,559,594 | A | * | 12/1985 | Sears et al. | 96/82 X |
| 4,713,093 | A | | 12/1987 | Hansson | 96/82 |
| 4,955,991 | A | | 9/1990 | Torok et al. | 96/50 |
| 5,010,777 | A | * | 4/1991 | Yehl et al. | 96/97 X |
| RE34,346 | E | | 8/1993 | Foster, Jr. et al. | 361/231 |
| 5,435,837 | A | | 7/1995 | Lewis et al. | 96/54 |
| 5,474,600 | A | | 12/1995 | Volodina et al. | 96/57 |
| 5,484,472 | A | | 1/1996 | Weinberg | 96/26 |
| 5,667,564 | A | * | 9/1997 | Weinberg | 96/80 X |
| 5,707,429 | A | | 1/1998 | Lewis | 96/63 |

* cited by examiner

*Primary Examiner*—Richard L. Chiesa
(74) *Attorney, Agent, or Firm*—Dowell & Dowell, P.C.

(57) ABSTRACT

An ionizing structure for ambient air treatment wherein the structure, optionally having ceiling-mounting provisions, incorporates an ionizing element forwardly directed in the direction of airflow through the structure, an electrical power supply coupled to the ionizing element for applying thereto a stepped-up, negative, direct-current voltage of the order of several thousand volts, and a buffer, in effect, in the form of electrical circuit means, e. g. a filter, operatively interposed between the power supply and the blower for preventing feedback of eddy-voltage spikes, transients and the like as may be generated in the power supply to the operative parts of the blower, thus preventing damage to the blower.

5 Claims, 5 Drawing Sheets

IONIZING STRUCTURE FOR AMBIENT AIR TREATMENT

BACKGROUND OF THE INVENTION

1. Field of Invention

The present invention relates to a structure or unit for treating ambient air and, more particularly, provides a unique ionizing structure, constructed for the treatment of ambient air, wherein the air conditioning is maximized, and is performed in such a manner that, in addition to producing negative-air-constituent ions, any dust, lint, and other particles will also simply be electrostatically charged negatively, so as to drop out of the air and fall to the floor of a room, for example, in which the structure is placed. A ceiling mount is provided to accommodate ceiling suspension of the unit, where desired. Most importantly, the structure contains an ionizing element, a voltage step-up power supply for applying a negative voltage of several thousand volts to the ionizing element, and a blower or fan for directing forced air over, in proximity with, and forwardly beyond the ionizing element, whereby to produce in the air stream ionized air constituents. A buffer stage, preferably in the form of an eddy-voltage filter, is operatively interposed between the power supply and the operative parts of the blower, whereby to prevent unwanted eddy-voltage spikes as may be generated in the power supply from feeding back to the operative parts of the blower. In a preferred form of the invention, such spikes can simply be filtered and grounded-out at the blower frame.

2. Description of Prior Art

The present invention presents an improvement over the inventor's prior U.S. Pat. No. 5,707,429, issued Jan. 13, 1998, which is fully incorporated herein by way of reference and is hereinafter referred to as "patent '429." Also made of record is the inventor's U.S. Pat. No. 5,435,837, issued Jul 25, 1995, likewise fully incorporated herein by way of reference. Tangential to certain aspects of the invention is certain other U.S. patent literature as follows: Reissue 34,346; U.S. Pat. Nos. 2,279,586; 3,046,716; 3,624,448; 3,768,258; 3,900,766; 3,915,672; 4,339,782; 4,713,093; 4,955,991; 5,474,600; and 5,484,472.

Of special relevance is the inventor's prior U.S. Pat. No. 5,707,429. Optimal operation of the inventor's ionizing structure has been found to occur when the power supply, supplied by general line power, 120–140 volts (AC), delivers to the ionizing element a stepped-up negative voltage of several thousand volts, generally of the order of 12.7 K volts (DC). Because of this requirement, there may be inadvertently generated at or proximate the power supply and ionizing element eddy-voltage spikes which in magnitude can exceed 62 K volts, which are apt to be fed back to the blower; such spikes can damage the operative parts of the blower, i.e. the armature and field windings of the blower motor. What the present invention addresses is the obviation of this hazard.

SUMMARY OF THE INVENTION

In the present invention, an ionizing structure for ambient air treatment includes a housing provided with an alternating-current voltage power input connection and having rearward inflow and forward outflow air vents; a blower having a frame and mounted in the housing and operatively positioned essentially between the inflow and outflow vents; an ionizing element mounted within the housing forward of the blower and proximate the outflow vents; and an electrical circuit structure coupled to and between the power input connection, blower, and ionizing element, whereby to supply magnitude-elevated, negative, direct-current voltage of the order of several thousand volts to the ionizing element, rated electrical power to the blower, and also to essentially block eddy-voltage spikes, transients and the like as may be generated with the electrical circuit from feeding back to the blower which might otherwise damage the blower. The blocking function may be performed by an eddy-voltage filter interposed between the power supply of the electrical circuit and the blower. Where the blower or fan has an electrically conductive frame, the filter can simply be coupled to the frame, for essentially grounding-out voltage spikes by serving as an energy-spike sink. The unit of the invention may have a housing comprised of upper and lower shells, the upper shell being provided with a bracket and riser structure accommodating a ceiling mount of the unit, as in a hospital where patients are to be deterred from manually manipulating the unit.

Broadly, the ionizing structure herein includes: an AC to DC power supply having an output providing a stepped-up negative voltage; an ambient-air ionizing element coupled to the output; a blower disposed rearwardly of the ionizing element for blowing ambient air forwardly over the ionizing element; and an AC eddy-voltage-spike blocking device operatively interposed between the power supply and the blower, whereby to protect the blower from eddy-voltage-spike damage.

As to the customary terms used herein: "K" means 1000, "AC" means alternating current, "DC" means direct current, L/C refers to inductance/capacitance, and rated power and line voltage refer to customary home or office AC input power at, e.g., 120–140 volts.

Accordingly, a primary object of the invention is to provide an ionizing device for treating ambient air and its constituents, wherein the blower or fan of the device is protected from high voltage transients, eddy-voltage spikes and the like.

A further object is to provide an ionizing device having a step-up power supply for generating an output of negative several thousand volts, an ionizing element coupled thereto, and a blower for directing ambient air over the ionizing element, wherein the operative parts of the blower are protected from transients, eddy-voltage spikes and the like, as may inadvertently be generated at or proximate the power supply, that might otherwise cause damage and hazard relative to such blower.

An additional object is to provide an ionizing device with structure suitable for mounting to a ceiling of a room, hospital area, and so forth, where occupant handling of the device is to be discouraged.

BRIEF DESCRIPTION OF DRAWINGS

The present invention may best be understood by reference to the following description, taken in connection with the accompanying drawings, in which.

DESCRIPTION OF THE PREFERRED EMBODIMENTS

Figure 1:
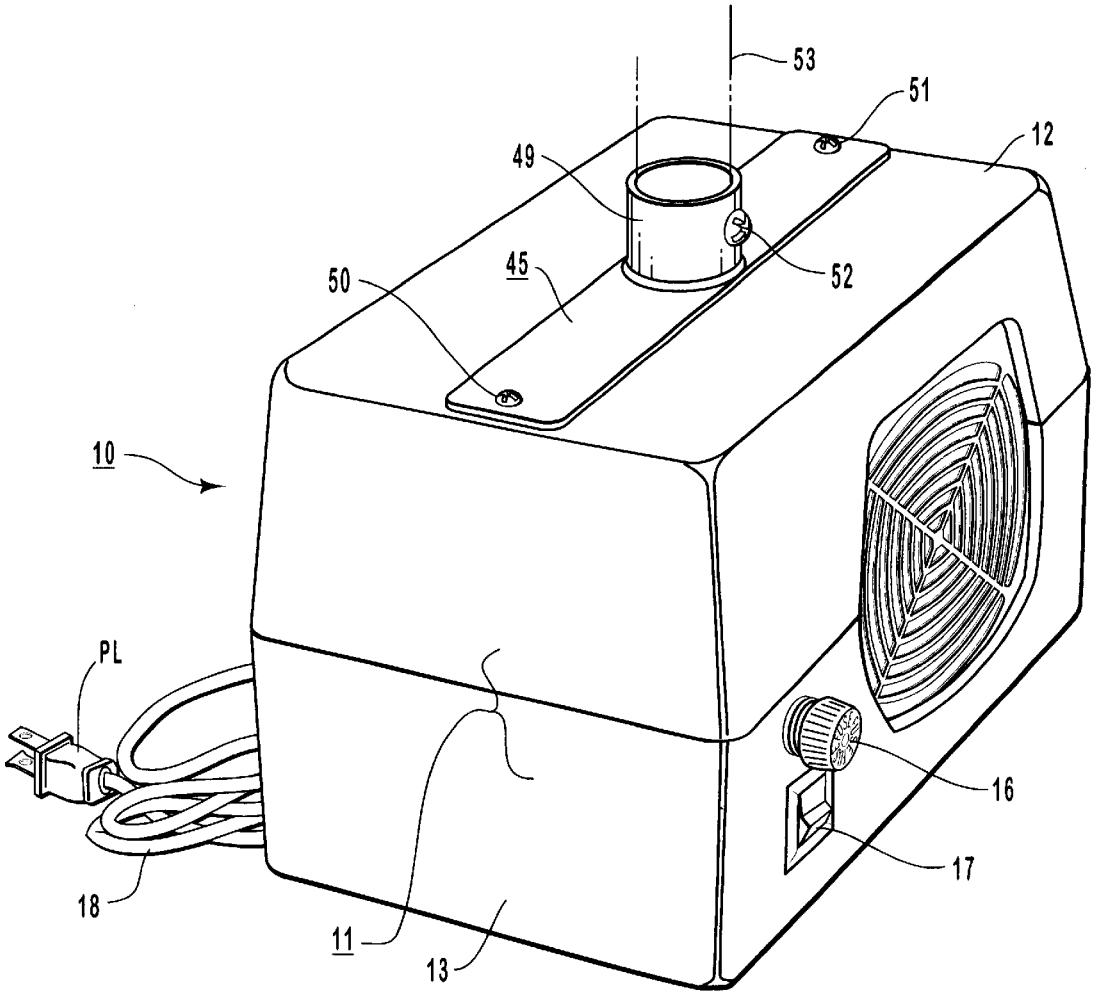
FIG. 1 is a front perspective view of an improved ionizing structure or unit, constructed in accordance with the principles of the present invention.
Figure 2:
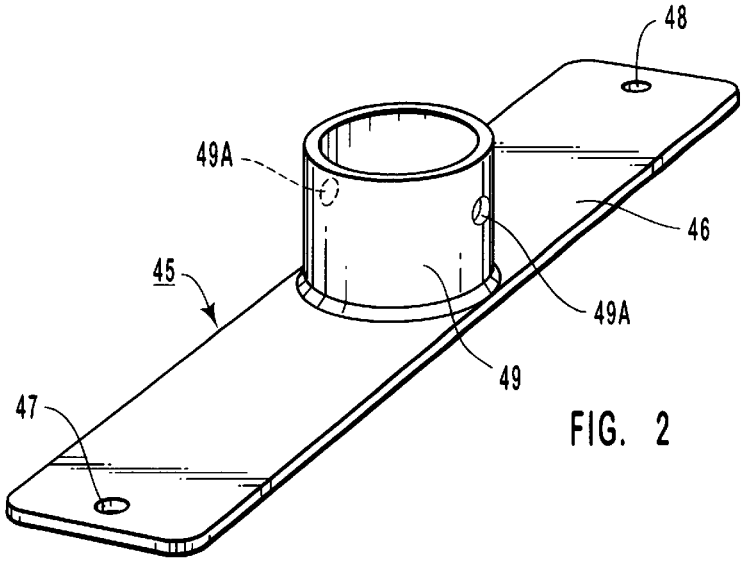
FIG. 2 is an enlarged front perspective view of a bracket, for securement to the unit of FIG. 1 as shown, whereby to accommodate the unit for spaced mounting to the ceiling of a room or hallway, for example.

In FIGS. 1–8 ionizing structure or unit 10 includes housing 11 provided with upper housing shell 12 and lower housing shell 13. Lower housing shell 13 includes base pads 14 as indicated.

Figure 3:
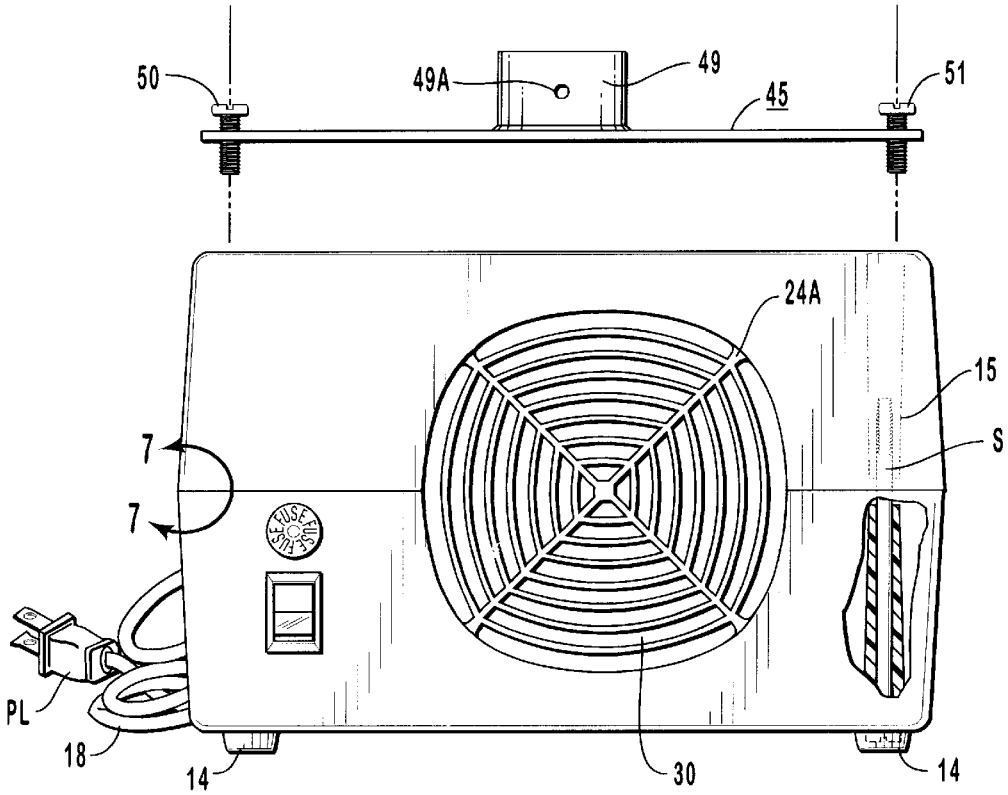
FIG. 3 is a front elevation assembly view of the unit of FIG. 1.
Figure 4:
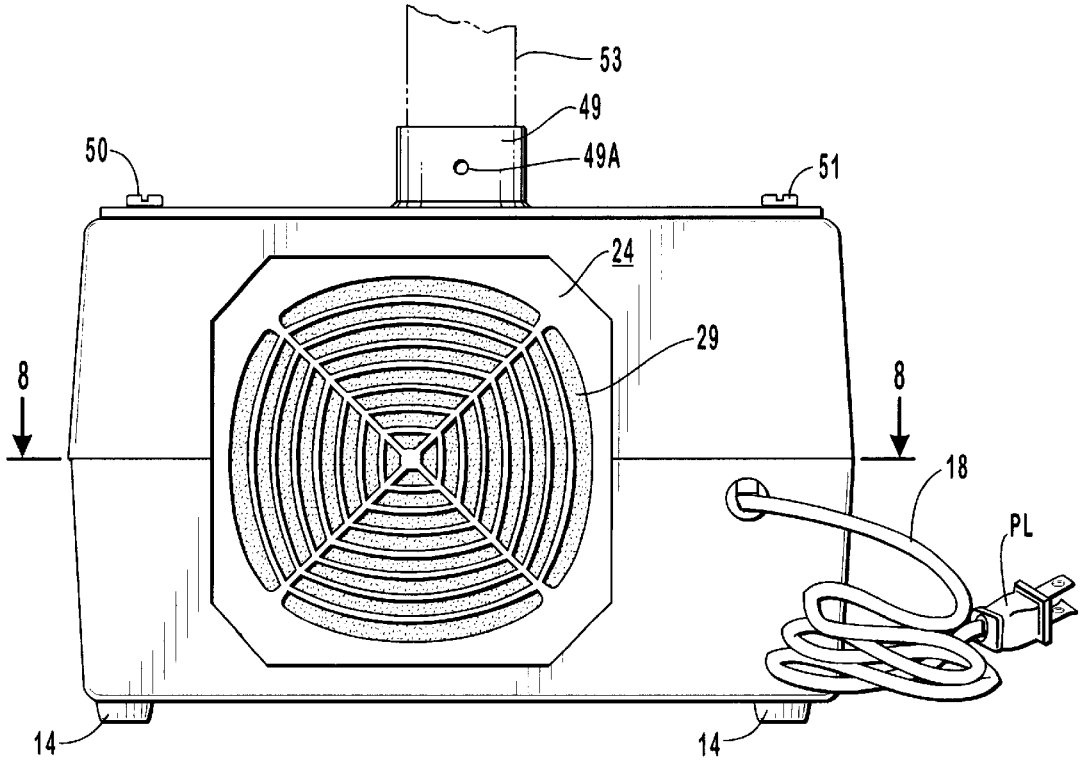
FIG. 4 is a rear elevation of the unit of FIG. 1.
Figure 5:
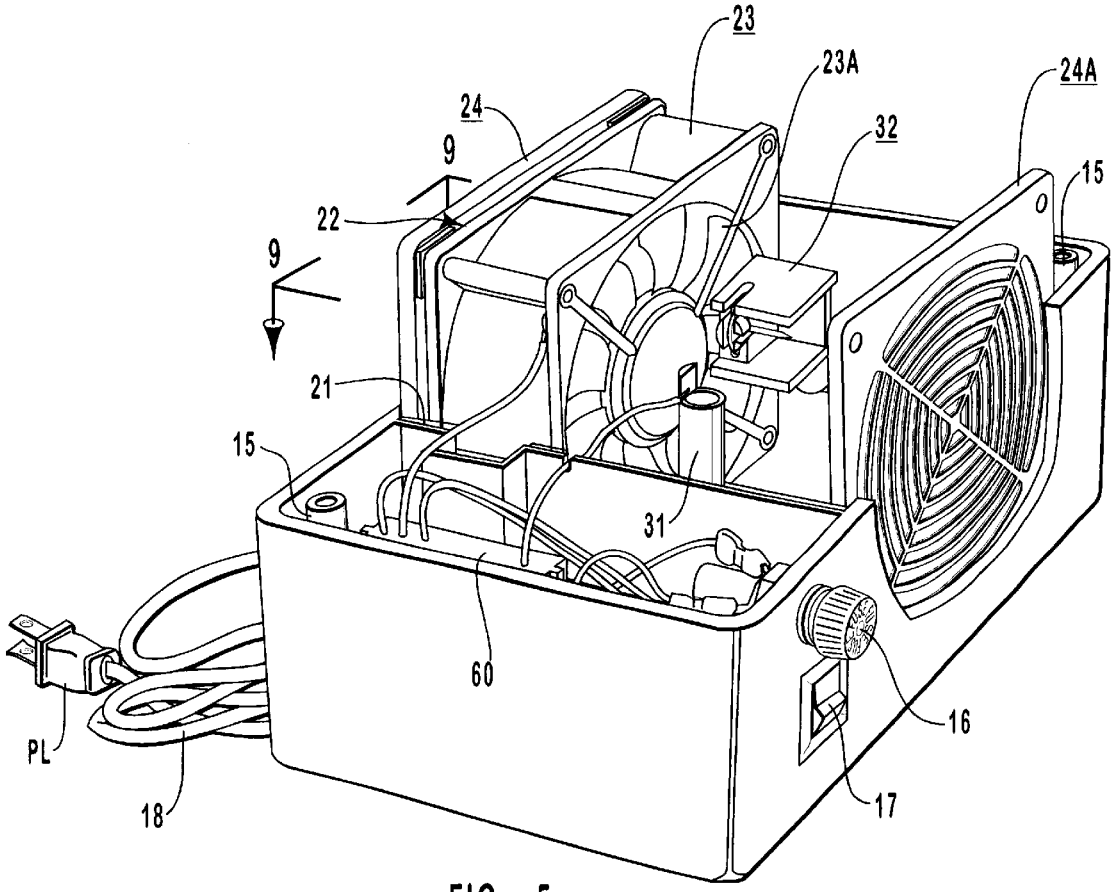
FIG. 5 is a front perspective view of the unit with the upper housing shell removed.

The two shells are secured together by a series of suitable elongated screws "S" which cooperate with the aligned screw receiving bosses 15 representative ones of which are seen in FIGS. 3 and 5. The screw heads, not shown, may be covered by removable base pads 14, as shown in FIG. 3. It is also seen that, mounted to the lower housing shell 13 are fuse unit 16 and on-off power switch 17 (with light 17A, FIG. 12), which may be of conventional manufacture. A power cord 18 having socket plug PL is likewise provided.

Figure 7:
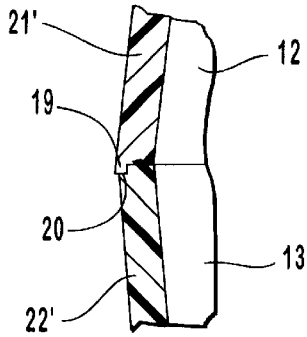
FIG. 7 is an enlarged fragmentary detail, taken along the arcuate line 7—7 in FIG. 3, of an edge portion of the unit's housing, showing the manner in which the edges of the upper and lower shells of the housing fit together, by way of example.
Figure 10:
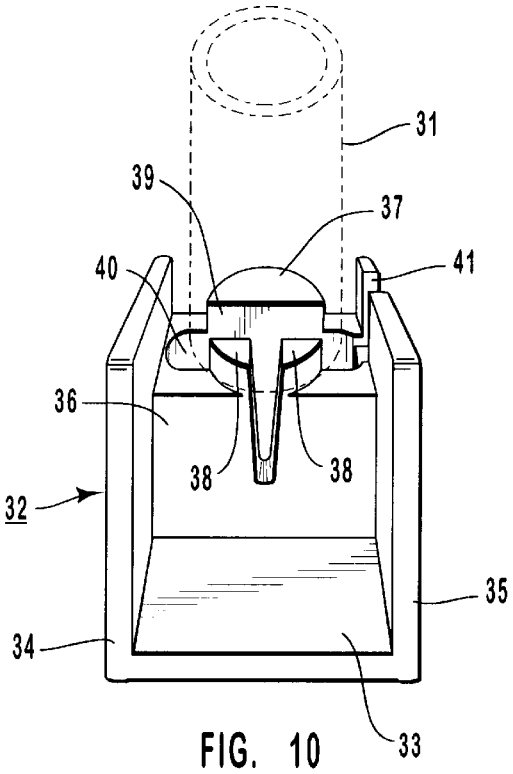
FIG. 10 is an inverted perspective view of a holder mounted within the housing for mounting the ionizing element.

It is noted that the two housing shells can be made to overlap, see FIG. 7, as by the provision of a peripheral shoulder 19 which fits in peripheral grooves 20. These will relate, of course, to the peripheral side walls 21' and 22' of the upper and lower housing shells 12 and 13.

Figure 8:
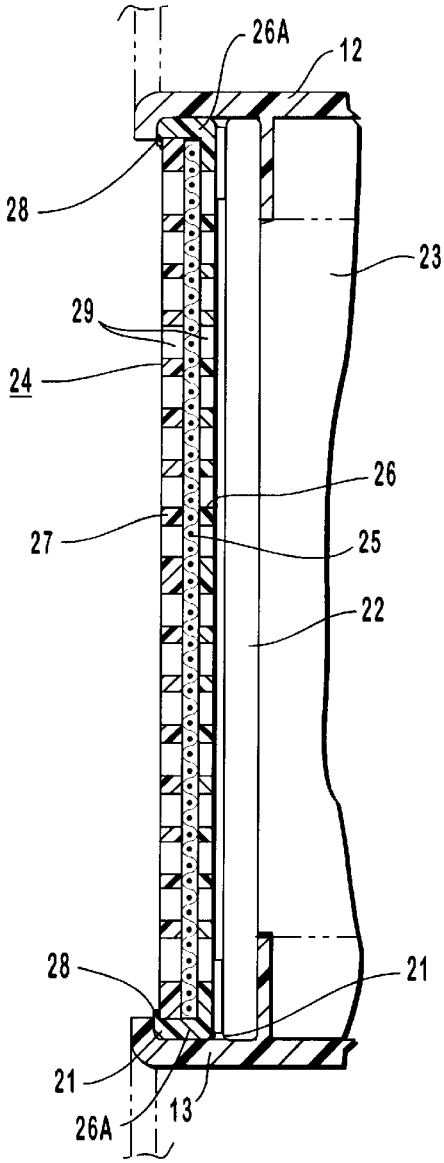
FIG. 8 is an enlarged partial cross section taken along line 8—8 of FIG. 4 rotated 90 degrees and having an airflow grill, typical for both front and back grill portions of the unit.

FIGS. 5 and 8 illustrate that the upper housing shell 12, and lower shell 13 as well, may be provided with a flange-formed pocket 21 into which is seated the rear flange 22 of blower 23 and the rear air-inflow filter grill unit 24. The rear filter grill unit 24, see FIG. 8, may take the form of an interior filter 25 having a perforate inner base support 26 and also outer grill member 27. Base support 26 may include a peripheral base flange 26A having overlapping lips at 28 to receive the outermost grill member 27. Referring to FIG. 5, the forward and rearward filter-grill units 24A and 24 may be identical, see FIG. 8, and also be mounted in similar fashion and with similar provision, both forward and rearward relative to the housing. In all cases, the filter-grill units have and therefore provide rearward air inflow vents 29 and also the forward air outflow vents 30, proximate and the rear and front of the blower of the unit, respectively.

Figure 6:
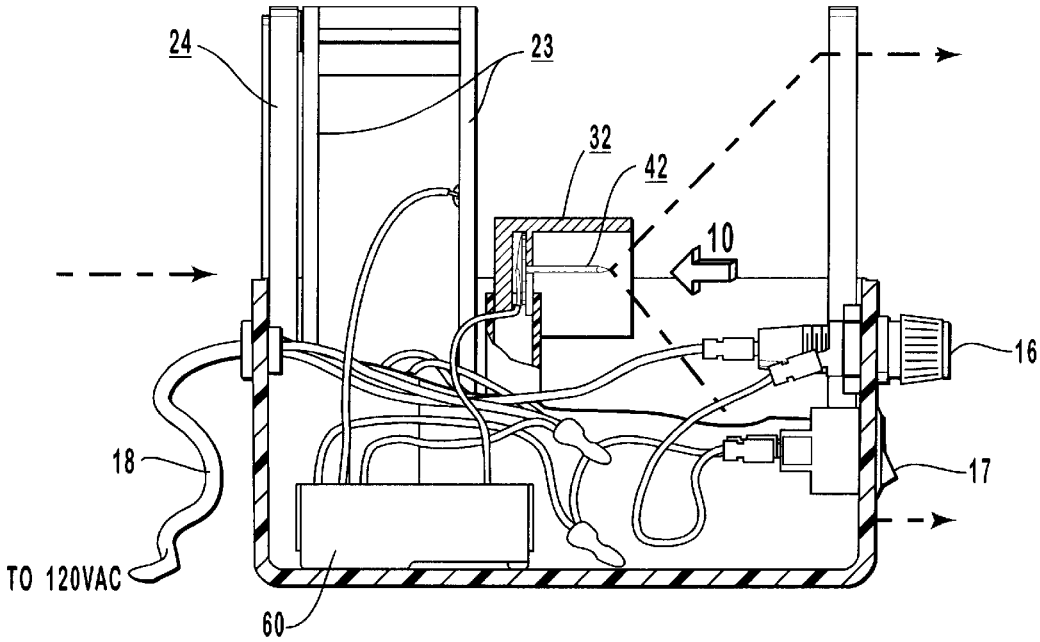
FIG. 6 is a cross-sectioned view of the unit of FIG. 5.
Figure 9:
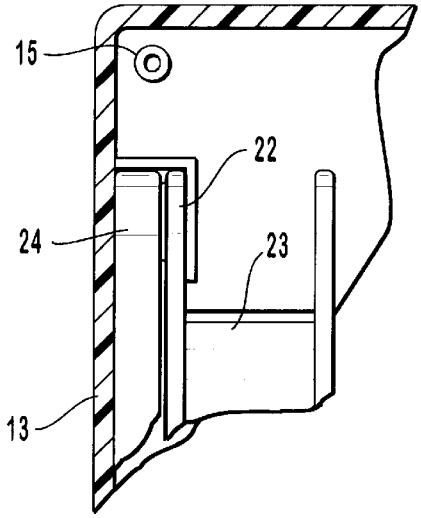
FIG. 9 is a fragmentary sectioned detail, looking down, of the fan mounting within the housing of the unit, and is taken along the long 9—9 in FIG. 5.

An ionizing element 42 can be mounted to and within the housing, in front of the blower, in any one of several ways. One means, as explained in patent '429, is for the lower housing shell to be provided with an upstanding cylindrical riser 31 over which a cover mount 32, designed to mount the ionizing element, is secured. The cover mount 32 is provided with a top 33 and opposite sides 34 and 35. A partition 36 is provided, together with rear and forward cylindrical sectors 37 and 38, designed to receive the inner bore surface of the riser 31. A rear surface 39 in combination with cavity 40 is designed to receive the head of the ionizing element. A side slot is also provided to receive a lead that attaches to the ionizing needle or element 42, as shown in FIG. 6. All of the above is fully explained in referenced patent '429. The ionizing element 42 is provided with a needle portion 43 and a head 44, see FIG. 12, integral therewith and fitting into cavity 40. FIG. 5 illustrates the positioning of the cover mount just prior to positioning the same over riser 31, and FIG. 6 shows the cover mount 32 positioned in place and containing the ionizing element 42 in operative position. All of the above is fully explained in the referenced patent '429.

In certain environments such as hospitals, recreational areas, and so forth, it may be desirous for the ionizing unit to be attached to and suspended from a ceiling structure. For this purpose a bracket 45 is optionally provided, see FIGS. 1 and 2, the same having a mounting plate 46, provided with mounting apertures 47 and 48, and also a tubular element 49, having attachment apertures 49A, secured thereto as by welding. The bracket is secured to the upper housing shell 12 by, e.g., screws 50, 51. A set screw or pin at 52, secures a post 53, depending from a ceiling, with the post being provided with one or more accommodating apertures. In this way, the unit can be suspended out of the reach of occupants of the building so as to meet safety considerations, and so forth.

Figure 11:
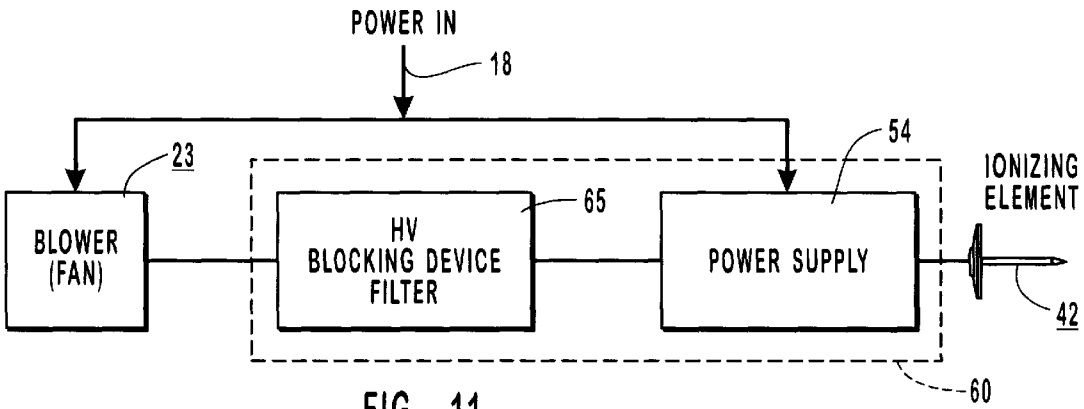
FIG. 11 is a schematic block diagram of the basic concept of the electrical circuitry of the invention.
Figure 12:
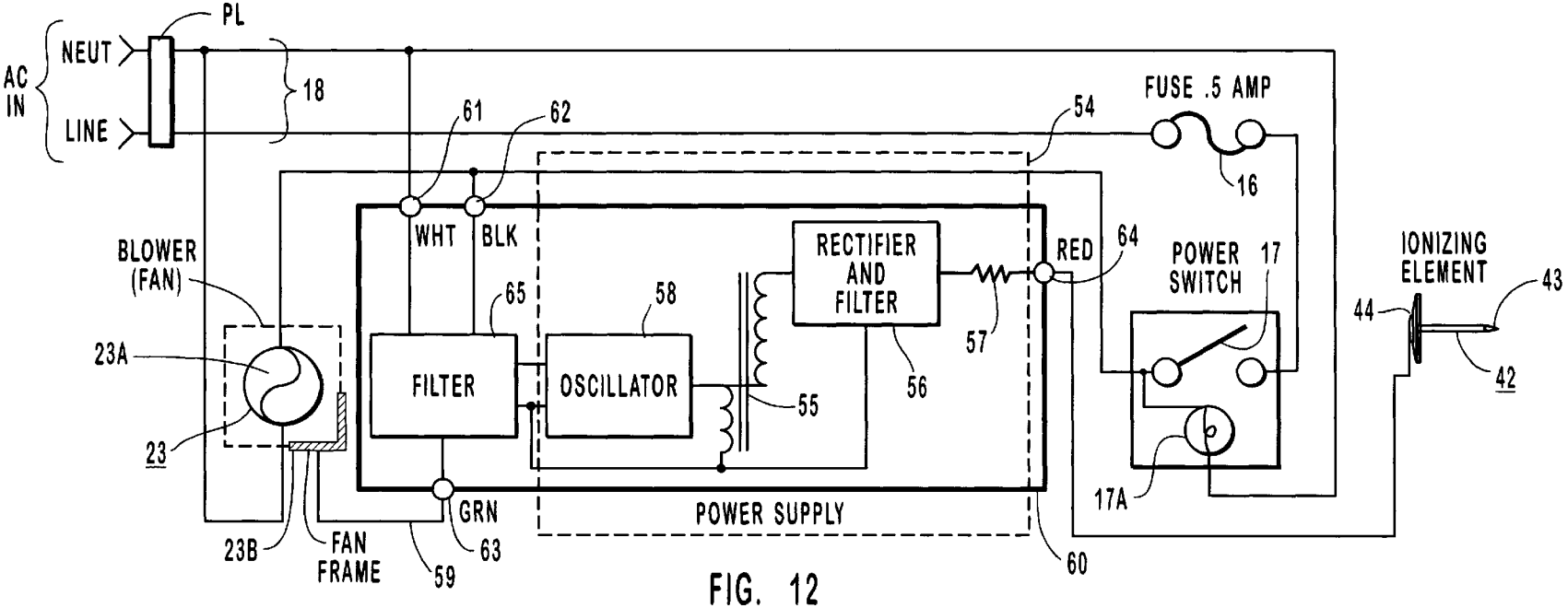
FIG. 12 is a block diagram, in greater detail, of the electrical circuit employed by the invention.

Special attention is now directed to the electrical circuit employed whereby to protect the blower or fan of the system/device, see in particular FIGS. 11 and 12.

The basic electrical circuit in generic, block diagram form is seen in FIG. 11. In this Figure input line power, at a customary voltage of 120–140 V (AC) is fed to power supply 54 and also to the blower or fan, hereinafter simply referred to as blower 23. The latter has operative parts 23A such as a rotating fan element, armature and field windings, etc. The blower is or may be a standard off-the-shelf unit. The complete circuit is illustrated in FIG. 12 wherein power supply 54 includes, electrically coupled together as indicated, a step-up transformer 55, a rectifier and filter unit (standard) 56, with, e. g., a resister 57 interposed in the output as an isolation or current-limiting element. An oscillator 58, such as a standard relaxation oscillator, is coupled to the input side of the transformer. The combination of oscillator 58, the transformer 55, rectifier and filter 56 and resistor 57 comprise a power supply, designed to be capable of generating a negative high-voltage output of several thousand volts, e.g., −12.7 K volts. This can be steady state or include a slightly undulating or ripple output, as desired. A high-voltage (spike) blocking device or filter 65, interposed between the oscillator 58 and blower or fan 23, as shown, prevents transients, high-voltage (HV) eddy spikes, as may be inadvertently generated in or appearing at the power supply, from feeding back to the blower or fan and damage or create a hazard to the operative parts of the blower, i.e. revolving fan element, armature and field windings of the fan motor, etc. One effective way to accomplish this isolation of the blower 23 from the power supply oscillator 58 is to have the filter ground at 63 electrically tied or coupled, e.g. by lead 59, directly to the frame 23B of the blower, where the latter is metallic and thus electrically conductive. The frame, when so connected to the oscillator 58, will serve as an eddy-voltage spike-energy sink, whereby to dissipate transient energies in the frame, that of course will be electrically isolated from the operative parts thereof. Filter 65 itself and standing along, may be a customary L/C filter, a voltage clipping and smoothing micro-circuit, etc., all of standard design, by way of example. The power supply 54 and eddy filter 65 can be encapsulated or potted as a single unit 60, shown as a darkened rectangle in FIG. 12 and as a block-like unit in FIGS. 5 and 6. This contributes to ease of assembly and connection. Unit 60 may have output terminals or projecting leads 61 (white or common), hot-wire 62 (black), ground 63 for fan frame (green), and ionizing-element negative-high-voltage terminal 64 (red).

What results is the provision of an electrical circuit, and components, wherein the fan or blower unit is protected from high-magnitude eddy voltage spikes, transients and the like, as may be generated or appear at the power supply and ionizing element circuit, from being fed back to the operative parts of the blower or fan, and damage the same or create a potential hazard.

While particular embodiments of the invention have been shown and described, it will be obvious to those skilled in the art that various changes and modifications may be made without departing from the essential features of the invention and, therefore, the aim in the appended claims is to cover all such changes and modifications and fall within the true spirit and scope of the invention.

What is claimed is:

1. An ionizing structure for ambient air treatment including; a housing provided with an alternating-current voltage power input connection and having inflow and outflow air vents, a blower having a frame and mounted in said housing and operatively positioned between said inflow and outflow vents, an ionizing element mounted within said housing intermediate said blower and said outflow vent, an electrical circuit coupled to and between said power input connection, said blower and said ionizing element, said electrical circuit including a power supply coupled to said input connection and having means for generating a negative direct-current voltage of an order of negative several thousand volts to be applied to said ionizing element, said electrical circuit including high voltage spikes blocking means for blocking eddy-voltage spikes and transients generated within said electrical circuit from feeding back to said blower and said high voltage spikes blocking means including an eddy-voltage filter coupled between said power supply and said frame of said blower, whereby to protect said blower from eddy-voltage-spike damage.

2. The ionizing structure of claim 1 wherein said power supply includes an oscillator, step-up transformer means coupled to said oscillator, and a rectifier-filter unit coupled to and between said step-up transformer means and said ionizing element.

3. The ionizing structure of claim 1 wherein said housing has upper and lower shells mutually fitted and secured together, said upper shell being provided with a support bracket having a riser, whereby to provide for spaced ceiling-mounting of the ionizing structure.

4. An ionizing structure for ambient air treatment including; a housing provided with an alternating-current voltage power input connection and having inflow and outflow air vents, a blower having a frame and mounted in said housing and operatively positioned between said inflow and outflow vents, an ionizing element mounted within said housing intermediate said blower and said outflow vent, an electrical circuit coupled to and between said power input connection, said blower, and said ionizing element, said frame of said blower being metallic and electrically conductive, said electrical circuit including a power supply coupled to said input connection and having means for generating a negative direct-current voltage of the order of minus several thousand volts to be applied to said ionizing element, said electrical circuit including high voltage spikes blocking means for blocking eddy-voltage spikes, and transients generated within said electrical circuit from feeding back to said blower to prevent damage to said blower, and said high voltage spikes blocking means including an eddy-voltage filter electrically intercoupled between said power supply and said frame of said blower, whereby to protect said blower from eddy-voltage-spike damage with said frame thereby serving as an energy-dissipating sink as to eddy-voltage-spike energies present.

5. The ionizing structure of claim 4 wherein said power supply includes an oscillator, step-up transformer means coupled to said oscillator, and a rectifier-filter unit coupled to and between said step-up transformer means and said ionizing element.

* * * * *